US006735922B2

(12) United States Patent
Paffen

(10) Patent No.: US 6,735,922 B2
(45) Date of Patent: May 18, 2004

(54) GLAZING PANEL AND INSULATED ASSEMBLY THEREOF

(76) Inventor: Peter Paffen, 1210 Industrial Way, Parksville, B.C. (CA), V9P 1R2

( * ) Notice: Subject to any disclaimer, the term of this patent is extended or adjusted under 35 U.S.C. 154(b) by 104 days.

(21) Appl. No.: 10/109,076

(22) Filed: Mar. 29, 2002

(65) Prior Publication Data

US 2003/0131557 A1 Jul. 17, 2003

(30) Foreign Application Priority Data

Jan. 11, 2002 (CA) ..... 2367716

(51) Int. Cl.[7] ..... E04C 2/54

(52) U.S. Cl. ..... 52/786.1; 52/786.13; 52/455; 52/456; 52/311.1; 52/204.593; 52/314; 428/34; 428/38

(58) Field of Search ..... 52/786.11, 311.1, 52/204.59, 204.593, 314, 789.1, 786.1, 663, 311.3, 786.13, 455, 456, 306, 307, 308, 457, 458, 202, 316; 428/34, 38

(56) References Cited

U.S. PATENT DOCUMENTS 2,132,217 A * 10/1938 Neuendorf ..... 52/204.593
2,841,004 A * 7/1958 MacCaferri ..... 52/390
4,518,446 A * 5/1985 Drennan ..... 156/63
4,671,031 A * 6/1987 Intengan ..... 52/203
4,828,004 A * 5/1989 Martinez ..... 160/229.1
5,033,245 A 7/1991 Kline
5,038,542 A 8/1991 Kline
5,079,886 A * 1/1992 Downs ..... 52/314
5,165,208 A * 11/1992 Lingemann ..... 52/456
5,494,715 A * 2/1996 Glover ..... 428/34
5,598,667 A * 2/1997 Dykes ..... 52/71
5,840,407 A 11/1998 Futhey et al.
5,843,546 A * 12/1998 Eichhorn ..... 428/38
6,138,433 A * 10/2000 Ridge ..... 52/786.11
6,177,156 B1 * 1/2001 Glover et al. ..... 428/34
6,240,685 B1 * 6/2001 Eichhorn ..... 52/204.61
6,250,027 B1 * 6/2001 Richards ..... 52/204.59

* cited by examiner

*Primary Examiner*—Carl D. Friedman
*Assistant Examiner*—Chi Q. Nguyen
(74) *Attorney, Agent, or Firm*—Frederick Kaufman

(57) ABSTRACT

The glazing panel, conform the present invention, comprises a panel of thermoplastic material provided with a three-dimensional decorative pattern. The latter includes elevated portions projecting outwardly from the three-dimensional decorative pattern and also simulated joints dividing the three-dimensional decorative pattern into the elevated portions. Each simulated joint has a transversal profile shaped into a groove with a flat bottom. A peripheral flat flange surrounds the elevated portions and the simulated joints as well and is connected to both by an inclined portion. An elevation L1, measured between the elevated portions and the flat bottoms, is lesser than an overall height L2, measured between the elevated portions and the peripheral flat flange. The elevated portions the flat bottoms and the peripheral flat flange are parallel to each other.

The insulated glazing panel comprises a pair of glazing panels. The pair of glazing panels is joined along internal confronting surfaces of the peripheral flat flanges by a sealing strip. The latter is interposed and adhesively secured to the internal confronting surfaces of the peripheral flat flanges. Thus, an undivided airtight chamber is formed by the two glazing panels which are held at a predetermined distance equal to a thickness L3 of the sealing strip, compounded with two overall heights L2.

1 Claim, 3 Drawing Sheets

GLAZING PANEL AND INSULATED ASSEMBLY THEREOF

I. BACKGROUND OF THE INVENTION

1. Field of the Invention

The present invention relates generally to glazing units and more particularly to a glazing panel and an insulated assembly thereof.

2. Description of the Prior Art

The use of traditionally decorative architectural windows, door windows, side lights and the like is known. Usually, these components have been made from relatively thick blocks, which are expensive and require an important amount of skilled labor. Furthermore, these architectural components have obvious disadvantages due to mechanical and thermal properties of the glass. Glass has reduced impact resistance, especially when deep grooves are used, and high heat transfer, especially when a single layer is used.

Attempts have been made in the past to replace the above structures with thermoplastic panels, which incorporate decorative features that simulate the appearance of traditional units. Thus, U.S. Pat. No. 6,250,027 dated Jun. 26, 2001 and granted to Richards for a "Glazing element", describes a glazing assembly including two panels of glass held at a predetermined distance by spacer bars positioned along and between the opposing inner edge portions of the panels. A laminar element made of plastic deformable material and provided with elevated and recessed portions is positioned between the two panels of glass, before they are assembled. The laminar element has its elevated portions close or in contact with the internal surface of one of the two panels. The glazing assembly comprising the laminar element, two panels of glass and the spacer bars and is sealed in a known way using a standard sealer. Richards glazing element can be characterized by two important shortcomings. First, due to the use of five elements, the assembly has a complex structure. Second, the spacer bars require a relative large width to accommodate the height of the laminar element and an air space for insulation behind this laminar element. U.S. Pat. No. 6,177,156 dated Jan. 23, 2001 and granted to Glover et al. for "Simulated divided light windows" discloses a first window assembly comprising a an inner and outer rigid glazing panels spaced less than 10 mm. A first vertical strip of adhesive tape of material is applied to the cavity surface of the inner glazing panel. To create a grid pattern, horizontal strips are applied at right angles to the first vertical strip. A second vertical strip of adhesive strip material is applied to the cavity surface of the outer glazing panel. The second vertical strip of adhesive tape material coincides with the first vertical strip. Horizontal strips are similarly applied to the second vertical strip. Other different strip patterns can be used. A second window assembly uses extruded plastic profiles. This second window assembly comprises an inner and outer glazing panels and a central glazing panel. The three glazing panels are spaced less than 10 mm apart. A decorative grid pattern made from plastic tape material is applied to the central glazing panel. Extruded plastic profiles, which are in coincidental alignment with the decorative grid pattern, are applied to external surfaces of inner and outer glazing panels. Glove's and al. windows are characterized by two main disadvantages. First, the window assembly uses a grid pattern attached to the internal surfaces of an inner and outer glazing panel. Thus, a limited degree of simulation is obtained. Second, the use of an internal grid pattern and an external system of extruded plastic profiles renders the structure of the window more complicated, while the simulation of the latter is not greatly enhanced. U.S. Pat. No. 6,138,433 dated Oct. 31, 2001 and granted to Ridge for an "Insulated glass unit window assembly including decorative thermoplastic sheet and method of forming" describes a decorative window assembly including a pair of spaced apart, opposed glass panels. A spacer member joins the latter along their peripheral edges and functions as a seal and a connector. A decorative thermoplastic panel having a three-dimensional decorative pattern is disposed in a chamber formed between the pair of opposed glass panels. The decorative thermoplastic panel is, preferably, attached to either of the glass panels, but it can be secured in place by spacers or end clips. The use of three panels for a window assembly renders Ridge's structure complicated. Furthermore, the use of a non-secured decorative thermoplastic panel leads to positional changes, which negatively affect the appearance of the simulated pattern. Finally, the use of spacers or clips for attaching the decorative thermoplastic panel is detrimental to the simplicity of the window assembly. U.S. Pat. No. 5,622,019 dated Apr. 22, 1997 and granted to Dorough, Jr. for a "Simulated glass-block structure" discloses a window assembly comprising two panels. Each panel includes a wavy surface on one side, a grid pattern on the other side and peripheral edges. The two panels are mounted in a rectangular window frame. The latter includes four separate frame pieces; each having two separated longitudinal slots for receiving and supporting the peripheral edges of the two panels. A spacer structure is interposed between the two panels. The former comprises a plurality of vertically and horizontally disposed spacers. Each spacer has a width approximately equal to the distance between the two panels. The spacer structure forms a grid corresponding to the shape and position of the grid pattern. Three main disadvantages are present in the above structure. First, besides the grid pattern, a spacer structure coincidental with the grid pattern is required. Thus, the window assembly is more expensive. Second, the window assembly is not airtight. Third, each frame piece requires two parallel, longitudinal slots for receiving the peripheral edges of the two panels. U.S. Pat. No. 5,079,886 dated Jan. 14, 1992 and granted to Downs for a "Decorative panel" relates to a planar glass panel combined with a decorative panel. The latter is constructed of plastic or other resilient material and secured in adjacent abutting relationship to either the outer or inner (or both) surfaces of the planar glass panel. A sealant or adhesive is used. The decorative panel can have a variety of profiles. Upon attaching with a sealant or adhesive of the decorative panel to a surface of the planar glass panel, a layer of air is trapped between them. Two shortcomings characterize Downs's panel. First, the layer of air is discontinued by the direct contact of the plurality of recessed portions of the decorative panel to the surface of the planar glass panel. Another shortcoming consists in the fact that the decorative panel is attached to either the outer or inner (or both) surfaces of the planar glass panel. When use is made of one decorative panel attached to one side of the planar glass panel, the simulation of an installed glass block is clearly seen only on one side. When a decorative panel is installed on each side of the planar glass panel, the decorative panel assembly will include three panels and a discontinued layer of air on each side of the planar glass panel.

The inventors believe that the cited patents taken alone or in combination neither anticipate nor render obvious the present invention. The foregoing citation of patents does not constitute an admission that they are relevant or material to the claimed subject matter. Rather, the cited patents relate only to the general field of the invention and are presented as constituting the closest art of which the inventors are aware.

II. SUMMARY OF THE INVENTION

Based on the analysis of the cited prior art, there is a need for a glazing panel and an insulated assembly thereof which eliminate or, at least, alleviate the foregoing shortcoming and disadvantages.

Thus, a first objective of the present invention is to provide a glazing panel and an insulated assembly thereof made of thermoplastic material, which are reliable and, as a direct result of comparatively lower material and labor costs, allow to reduce the total costs. Such savings may be passed to the users, which constitute an undeniable advantage.

A second objective of this invention is to provide a well-engineered glazing assembly having a relatively large width to enhance the thermal efficiency, while using relatively narrow frames with only one longitudinal groove for positioning two joined glazing panels.

Broadly stating, a glazing panel, conform the present invention, comprises a panel of thermoplastic material provided with a three-dimensional decorative pattern. The latter includes elevated portions projecting outwardly from the three-dimensional decorative pattern and also simulated joints dividing the three-dimensional decorative pattern in the elevated portions. Each simulated joint has a transversal profile shaped into a groove with a flat bottom. A peripheral flat flange surrounds the elevated portions and the simulated joints as well and is connected to both by an inclined portion. An elevation L1, measured between the elevated portions and the flat bottoms, is lesser than an overall height L2, measured between the elevated portions and the peripheral flat flange. The elevated portions the flat bottoms and the peripheral flat flange are parallel to each other.

In one aspect of the invention, the glazing panel has the three-dimensional decorative panel divided by horizontal and vertical simulated joints into elevated portions. Each of the simulated joints has a wedge-shaped groove flared towards its top, a flat bottom and beveled edges. Thus, the elevated portions together with the simulated joints imitate genuine glass cut blocks.

In another aspect of the invention, means for enhancing the appearance of the three-dimensional pattern is applied to the flat bottoms.

Broadly stating, an insulated glazing panel comprises a pair of glazing panels. Each glazing panel includes a panel of thermoplastic material provided with a three-dimensional decorative pattern. The latter includes elevated portions projecting outwardly from the three-dimensional decorative pattern and also simulated joints dividing the three-dimensional decorative pattern into the elevated portions. Each simulated joint has a transversal profile shaped into a groove with a flat bottom. A peripheral flat flange surrounds the elevated portions and the simulated joints as well and is connected by an inclined portion. An elevation L1, measured between the elevated portions and the flat bottoms, is lesser than an overall height L2, measured between the elevated portions and the peripheral flat flange. The elevated portions the flat bottoms and the peripheral flat flange are parallel to each other and each of the glazing panels constitutes a mirror image of an opposed one and is so juxtaposed to project the elevated portions outwardly therefrom. The pair of glazing panels is joined along internal confronting surfaces of the peripheral flat flanges by a sealing strip. The latter is interposed and adhesively secured to the internal confronting surfaces of the peripheral flat flanges. Thus, an undivided airtight chamber is formed by the two glazing panels held at a predetermined distance equal to a thickness L3 of the sealing strip, compounded with two overall heights L2.

III. BRIEF DESCRIPTION OF THE DRAWINGS

Although the characteristic features of the invention will be particularly pointed out in the claims, the invention itself, and the manner in which it may be made and used, may be better understood by referring to the following description taken in connection with the accompanying drawings forming part thereof, wherein like reference numerals refer to like parts throughout the several views in which:

IV. DESCRIPTION OF A PREFERRED EMBODIMENT

Figure 1:
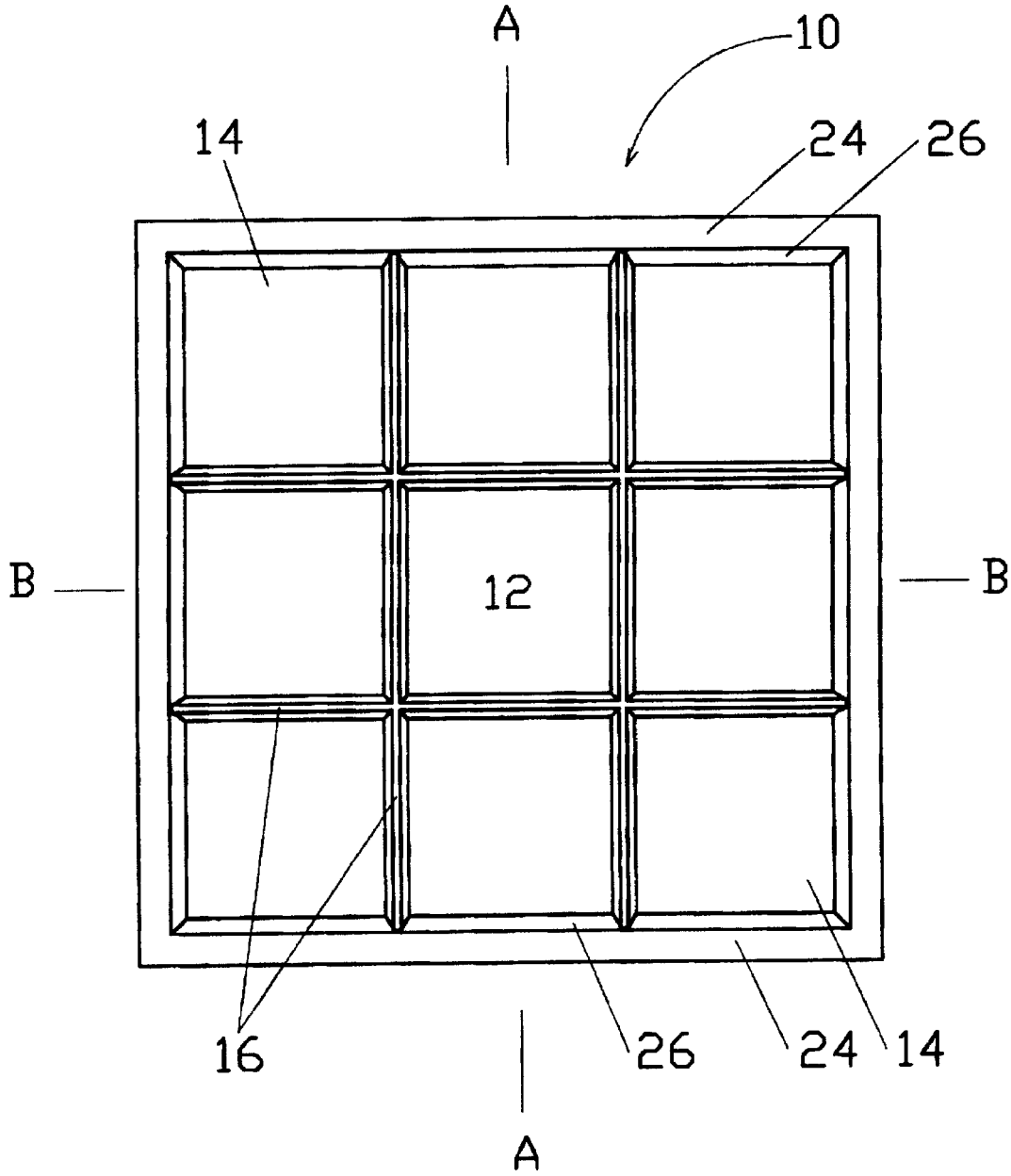
FIG. 1 is a front elevation of a glazing panel according to the invention.
Figure 2:
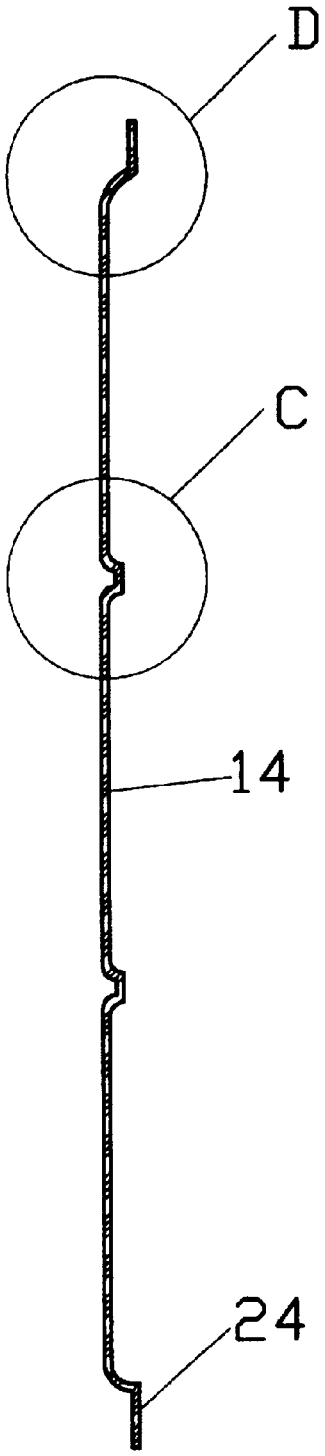
FIG. 2 is a sectional view taken along line A—A or line B—B of FIG. 1.
Figure 4:
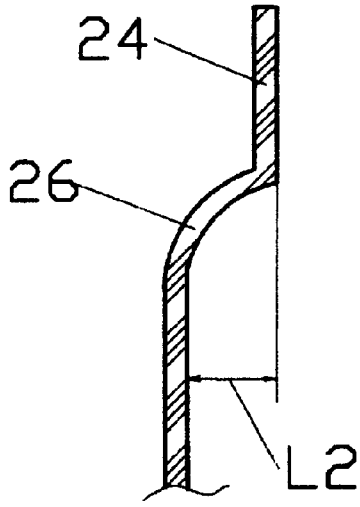
FIG. 4 shows, in a larger scale, a fractional portion D of FIG. 2.
Figure 3:
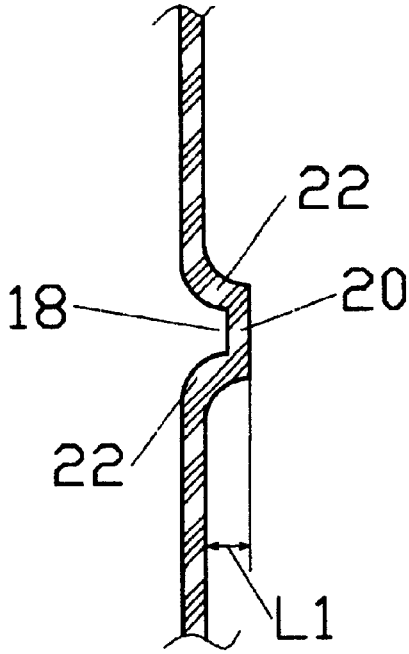
FIG. 3 shows, in a larger scale, a fractional portion C of FIG. 2.

The reference numeral 10 generally refers to a glazing panel, in accordance with the present invention, illustrated in FIGS. 1 to 4. Glazing panel 10 is formed from thermoplastic material, such as clear acrylic ⅛" sheet, and provided with a three-dimensional decorative pattern 12 with a wavy surface, which imitate genuine glass cut blocks. Three-dimensional decorative pattern 12 comprises elevated portions 14, which project outwardly therefrom, similarly to that of separately installed genuine glass cut blocks. Use is made of simulated joints 16, which divide three-dimensional decorative pattern 12, horizontally and vertically, into elevated portions 14. Each simulated joint 16 has a transversal profile representing a wedge-shaped groove 18. The latter is flared towards its top and has a flat bottom 20 and beveled edges 22 curved at their extremities. Flat bottom 20 of simulated joints 16 and elevated portions 14 of three-dimensional decorative pattern 12 are parallel to each other. Beveled edges 22 and flat bottom 20 imitate corresponding features seen in genuine glass cut blocks.

A peripheral flat flange 24 surrounds elevated portions 14 and simulated joints 16 and is connected to both by an inclined portion 26. Peripheral flat flange 24, elevated portions 14 and flat bottom 20 are parallel to each other.

An elevation L1, measured between elevated portions 14 and flat bottom 20, is lesser than an overall height L2, measured between elevated portions 14 and peripheral flat flange 24. The purpose of this difference in values is critical for the present invention and will be explained further in this description.

Preferably, on flat bottom 20 may be applied, on its inwardly or outwardly exposed surfaces, silk screening, calking compound, paint, ink or the like. Thus, the whole appearance of three-dimensional decorative pattern 12 is enhanced, so that a more realistic simulation of glass cut blocks is obtained.

Figure 5:
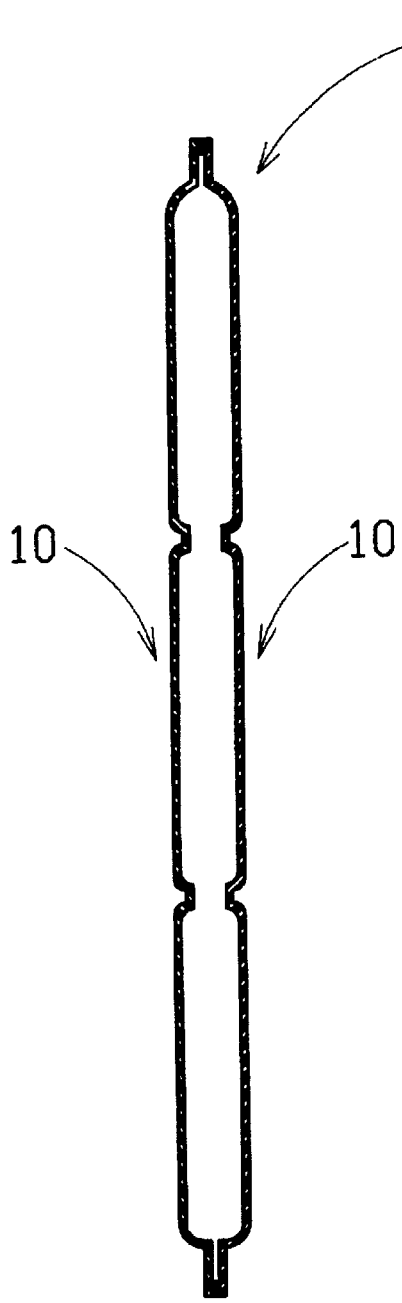
FIG. 5 is a view similar to FIG. 2 but showing a pair of juxtaposed glazing panels forming an insulated assembly according to the present invention.
Figure 6:
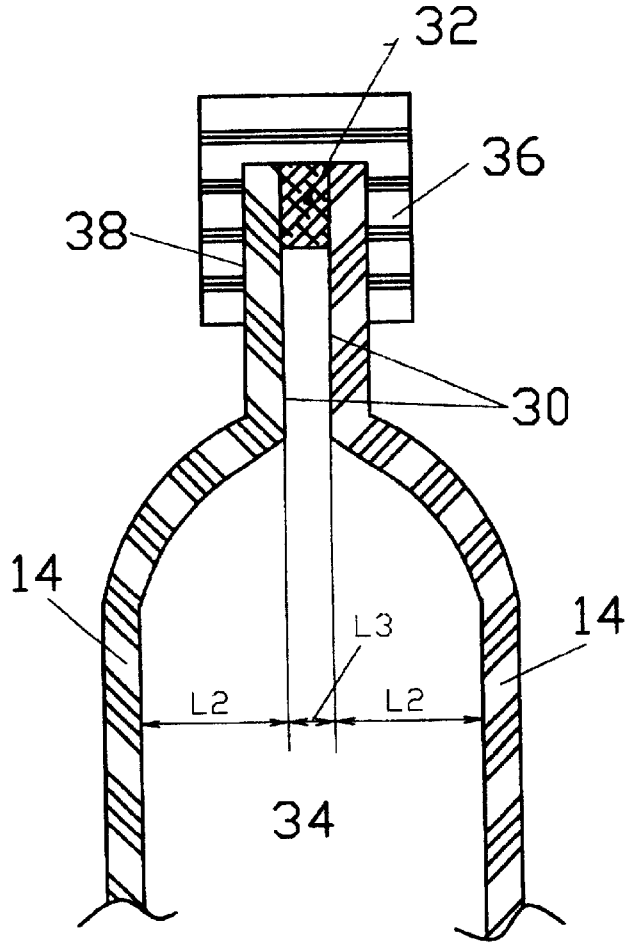
FIG. 6 is a fragmentary view of FIG. 5 together with a portion of the frame of the insulated assembly.

Three-dimensional decorative pattern 12 can be selected from a variety of profiles to provide versatility in the choice of a desired appearance for windows, door lights, dividing panels, furniture, etc. In the above described and illustrated example, elevated portions 14 are square, but any other shape, such as, for example, rectangular, rhomboid, circular, oval etc. may be considered Turning now to the cross section shown in FIG. 5, numeral 28 generally designates an insulated glazing assembly. The latter is constructed of two opposed glazing panels 10 with their elevated portions 14 projecting outwardly therefrom, similarly to that of genuine glass cut blocks. Thus, an insulated glazing assembly 28 in the form of a double glazed panel is obtained, one glazing panel 10 constituting a mirror image of another juxtaposed glazing panel 10.

Two glazing panels 10 of insulated glazing assembly 28 are joined along internal confronting surfaces 30 of their peripheral flat flanges 24. Use is made of a sealing strip 32, interposed and adhesively secured to internal confronting surfaces 30. An adhesive ⅛"×⅜" glazing tape produced by Tremco under the trade name TRG 600 is usually used.

Insulated glazing assembly 28 includes an undivided airtight chamber 34, located between two glazing panels 10, which are opposed and held at a predetermined thermally efficient distance, equal to a thickness L3 of sealing strip 32 compounded with two overall heights L2.

In the case of relatively large insulated glazing assemblies 28, glazing panels 10 are susceptible to deformation. To prevent this to happen, several spacers (not shown) of relatively reduced length are interposed between outwardly extending flat bottom 20 of simulated joints 16. Thus, the overall rigidity of large insulated glazing assemblies 28 is significantly enhanced. Since, typically, the number and the length of the spacers are limited, the role as a thermal barrier of non divided airtight chamber 34, which prevents the flow of thermal energy, is essentially maintained.

Insulated glazing assembly 28 is surrounded by a frame 36 having one longitudinal internal slot 38 for positioning an end portion of peripheral flat flanges 24, joined together by sealing strip 32. Thus, the thickness of frame 36 is not determined by the width of insulated glass assembly 28 including non divided airtight chamber 34, the latter overhanging from both sides of frame 36.

As required, a detailed embodiment of the present invention is disclosed in the foregoing description; however, it is to be understood that the disclosed embodiment is merely exemplary of the invention, which may be embodied in various forms. Therefore, specific structural and functional details disclosed therein are not to be interpreted as limiting, but merely as a basis for the claims and as a representative basis for teaching one skilled in the art to variously employ the present invention in virtually any appropriately detailed structure.

The embodiments of the invention in which an exclusive property or privilege is claimed are defined as follows:

1. Insulated glazing assembly comprising, a frame comprising an internal longitudinal slot;

two opposed glazing panels of thermoplastic material, each of said two opposed glazing panels having a three-dimensional pattern, divided by simulated joints in elevated portions projecting outwardly from each of said two opposed glazing panels, each of said simulated joints having a bottom;

a peripheral flat flange surrounding said simulated joints and said elevated portions, said peripheral flat flange including an internal confronting surface and an end portion; and a sealing strip interposed between and adhesively secured to said two opposed glazing panels, respectively to their internal confronting surfaces;

an elevation L1, measured between said elevated portions and said bottom, is lesser than an overall height L2, measured between said elevated portions and said peripheral flat flange;

said insulated glazing assembly being provided with an undivided airtight chamber, located between said two opposed glazing panels, which are held at a predetermined thermally efficient distance, equal to a thickness L3 of said sealing strip compounded with two overall heights L2, and in said internal longitudinal slot of said frame being positioned said end portions of said peripheral flat flanges joined by said sealing strip, so that a thickness of said frame is not determined by a width of said insulated glazing assembly including said non divided airtight chamber, but by thicknesses of said peripheral flat flanges and said sealing strip.

* * * * *